United States Patent [19]

Pierce et al.

[11] 4,074,666

[45] Feb. 21, 1978

[54] CARBURETION SYSTEM FOR AN INTERNAL COMBUSTION ENGINE

[76] Inventors: Sherman L. Pierce, P.O. Box 81; Harold D. Pierce, P.O. Box 73, both of Birchwood, Tenn. 37308

[21] Appl. No.: 614,124

[22] Filed: Sept. 17, 1975

[51] Int. Cl.[2] ..... F02M 17/22

[52] U.S. Cl. ..... 123/134; 123/133; 261/119 R

[58] Field of Search ..... 123/133, 134, 131, 132; 261/121, 119 R

[56] References Cited

U.S. PATENT DOCUMENTS

| | | | |
|---|---|---|---|
| 245,443 | 8/1881 | Callahan | 261/119 R |
| 1,121,137 | 12/1914 | Schoonmaker | 123/134 R |
| 1,530,882 | 3/1925 | Chapin | 123/134 |
| 1,997,497 | 4/1935 | Pogue | 261/121 |
| 2,122,076 | 6/1938 | Voorhees | 261/121 R |
| 2,221,472 | 12/1940 | Ennis | 261/121 R |
| 2,650,582 | 9/1953 | Green | 123/134 |
| 2,650,810 | 9/1953 | Nordell | 261/121 R |
| 3,049,850 | 8/1962 | Smith | 123/134 |

FOREIGN PATENT DOCUMENTS

| | | | |
|---|---|---|---|
| 19,061 of | 8/1896 | United Kingdom | 261/119 R |

*Primary Examiner*—Ronald H. Lazarus
*Attorney, Agent, or Firm*—Fitch, Even, Tabin & Luedeka

[57] ABSTRACT

A carburetion system for use in combination with an internal combustion engine including a closed fuel container in which fuel fed from a reservoir is maintained at a predetermined level and air drawn into the fuel container is distributed adjacent the surface of the fuel to form a combustible gaseous mixture. The combustible mixture is then drawn into the combustion chamber of an internal combustion engine for ignition. The concentration of fuel in the mixture is varied by adjusting the vertical displacement of the diffuser relative to the surface of the fuel in the fuel container.

5 Claims, 5 Drawing Figures

CARBURETION SYSTEM FOR AN INTERNAL COMBUSTION ENGINE

This invention relates to a carburetion system for an internal combustion engine and more particularly concerns a carburetion system including means for adjusting the concentration of fuel in a fuel-air mixture furnished to the combustion chamber of an internal combustion engine.

Carburetion systems provide internal combustion engines with a combustible mixture including atomized or vaporized fuel mixed with air. Generally, when the combustible mixture fed into the combustion chamber of the internal combustion engine is vaporized, the fuel is more completely burned thereby increasing the engine efficiency and reducing engine pollution. To this end it is desirable to vary the relative amounts of fuel and air in the combustible mixture, i.e. richness, to accommodate varying conditions of engine operation.

Heretofore in carburetion systems, it has been common to introduce liquid fuel in an atomized state into a carburetor, that is physically separated from the liquid fuel storage vessel, while simultaneously pulling air from the ambient atmosphere into the carburetor where the air and atomized fuel are mixed and thereafter conveyed to the combustion chamber of the internal combustion engine. In this type system, it is important that the relative quantities of fuel and air be carefully controlled to afford the correct richness of the mixture fed to the combustion chamber. This has entailed complicated valving and control devices that have increased the complexity and cost of carburetion systems.

In other systems, it has been proposed to compress the air prior to its introduction to the carburetor, thereby adding the cost of an air compressor device to the carburetion system. In still other carburetion systems, air has been bubbled through a quantity of liquid fuel and thereafter conveyed to the combustion chamber of an engine. In the latter instance, difficulty is experienced in regulating the richness of the mixture for various engine operating conditions.

Accordingly, it is an object of this invention to provide a carburetion system in combination with an internal combustion engine which employs the flow of incoming air in vaporization of the liquid fuel and in mixing the fuel vapor with air to form a combustible mixture. It is a further object of this invention to provide a carburetion system which supplies a combustible mixture directly from a liquid fuel container into the combustion of an internal combustion engine.

Other objects and advantages of the invention will become apparent by reference to the following description, including the accompanying drawings in which.

Figure 1:
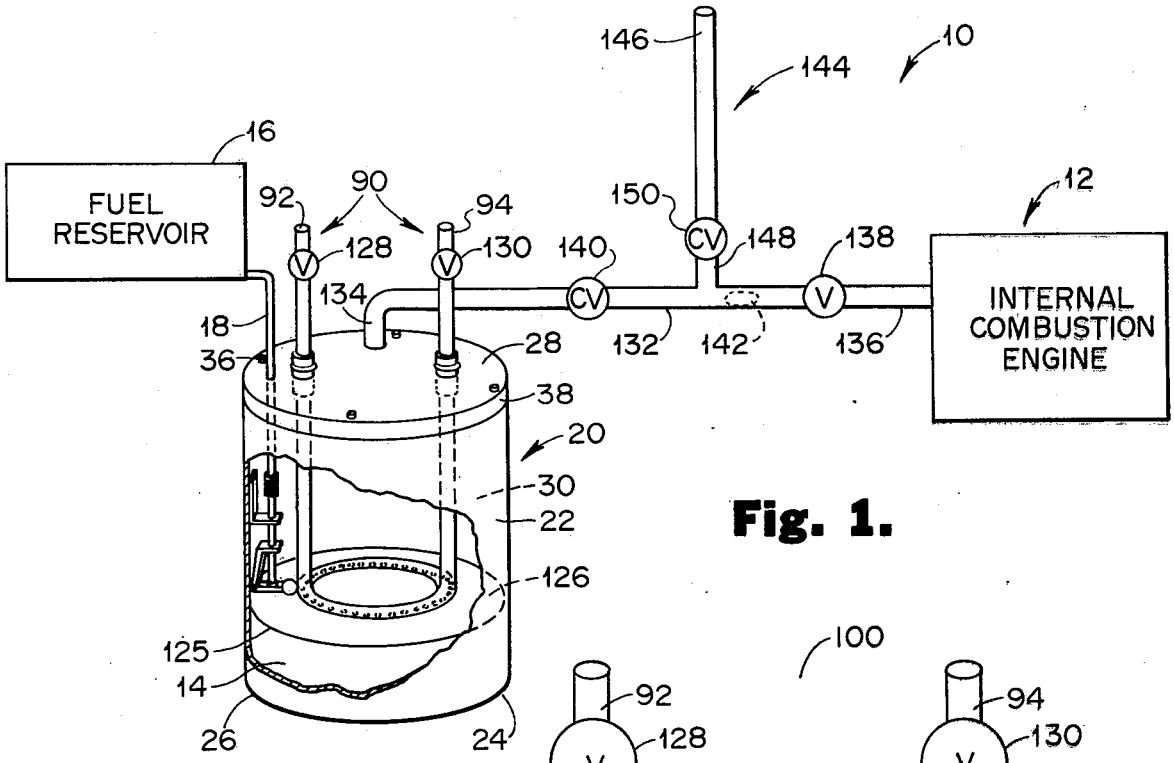
FIG. 1 is a schematic illustration of a carburetion system, having a fuel container means shown in a perspective view with a portion of the container wall thereof broken away, showing various features of the invention.

A carburetion system is provided in combination with an internal combustion engine having a cylinder defining a variable volume combustion chamber and means defining an inlet passage to deliver a combustible mixture to the combustion chamber. The disclosed carburetor system includes a fuel reservoir and a closed fuel container connected in fluid communication. Control means is provided for maintaining a predetermined level of liquid fuel in the fuel container. Air intake means including diffuser means is provided to distribute air adjacent the surface of the fuel in the container to aid in vaporization of the liquid fuel and to form a combustible gaseous mixture in the fuel container. This mixture is drawn into the combustion chamber of the internal combustion engine through conduit means having check valve means arranged to prevent ignition of the fuel in the container. The proximity of the diffuser to the surface of the liquid fuel in the fuel container is adjustable to select the rate of fuel vaporization and the relative quantities of air and fuel vapor within the container, thus to vary the richness of the fuel-air mixture fed to the engine. Such proximity is chosen to provide maximum utilization of the fuel through mixing of the fuel and air in proper proportion prior to introduction of the mixture into the combustion chamber of the engine.

Referring to the Figures, a carburetion system constructed in accordance with the present invention is indicated generally at 10. This system finds particular application in combination with stationary internal combustion engines, indicated at 12, operated under a variety of conditions such as those used in industrial facilities. In the depicted system, liquid fuel 14 is stored in a fuel reservoir 16 from which it is fed through a conduit 18 from the reservoir 16 into a fuel container means, indicated generally at 20, which in the illustrated embodiment, comprises a generally cylindrical wall 22 integrally formed at its lower edge 24 with a circular base 26 and closed at its top edge by a removable cover 28, thereby defining a chamber 30 within the fuel container. An annular gasket 32 is interposed between the upper edge 34 of the cylindrical wall 22 and the cover 28 to provide a seal to assist in preventing the escape of vaporized fuel from the confines of the chamber 30. The cover is removably fastened in position as by screws 36. The illustrated cover 28 includes at its peripheral margin, a depending cylindrical wall portion 38 which overhangs the top portion of the cylindrical wall 22 of the container means 20 when the cover 28 is secured to the container means 20 by screws 36, bolts or the like.

As depicted, the conduit 18 extends through the cover 28 and depends therefrom into the interior of the chamber 30. The lower terminal end 42 of the conduit is connected in fluid communication with a further conduit 44 including a length of flexible conduit 46. The conduit 44 is received in one leg 48 of an L-shaped bracket 50 whose other leg 52 is secured to the interior surface of the wall as by a bolt 54. The leg 52 of the bracket is provided with an elongated slot 56 within which the bolt 54 resides to thereby provide for adjustment of the vertical position of the bracket 50 and the conduit 44. Further adjustment of the vertical position of the conduit 44 within the chamber is provided for by splitting the end 58 of the leg 48 and after the conduit 44 is disposed in the split end, a bolt 60 is tightened to pull the end portions into frictional engagement with the conduit 44.

The lower end 62 of the conduit 44 serves as the outlet for fuel introduced into the chamber 30. This outlet 62 is opened and closed by means of a float valve 64 including a float 66 disposed on the outboard end 72 of a float arm 70 whose opposite end 74 is pivotally secured to one end 76 of a mounting bracket 78 that is secured at its opposite end 80 to the conduit 44 as by bolts 82 and 84. The upper surface 86 of the float arm 70 is provided with a pad 88, for example, in position to bear against and seal the end 62 of the conduit 44 when the liquid level within the chamber 30 causes the float 66 to rise and force the pad against the conduit end. When the liquid level within the chamber falls, the float is lowered to move the pad out of sealing engagement with the conduit end and permit fuel to flow by gravity into the chamber to thereby raise the liquid level to the desired height within the chamber 30.

Air is introduced to the chamber 30 as by air intake means generally designated at 90 and comprising a pair of tubular inlets 92 and 94 extending through spaced apart openings 96 and 98 in the cover 28 to provide fluid communication between the chamber 30 and ambient atmosphere 100. In the illustrated embodiment, the tubular inlets 92 and 94 are slidably mounted in respective cylindrical housings 102 and 104 extending through the cover 28. "O" rings 106 and 108 mounted in circumferential grooves 110 and 112 form a gas-tight seal between the inlets 92 and 94 and the respective housings 102 and 104 to prevent the escape of vaporized fuel from the chamber while providing for sliding vertical adjustability of the inlets with respect to the chamber 30.

Figure 2:
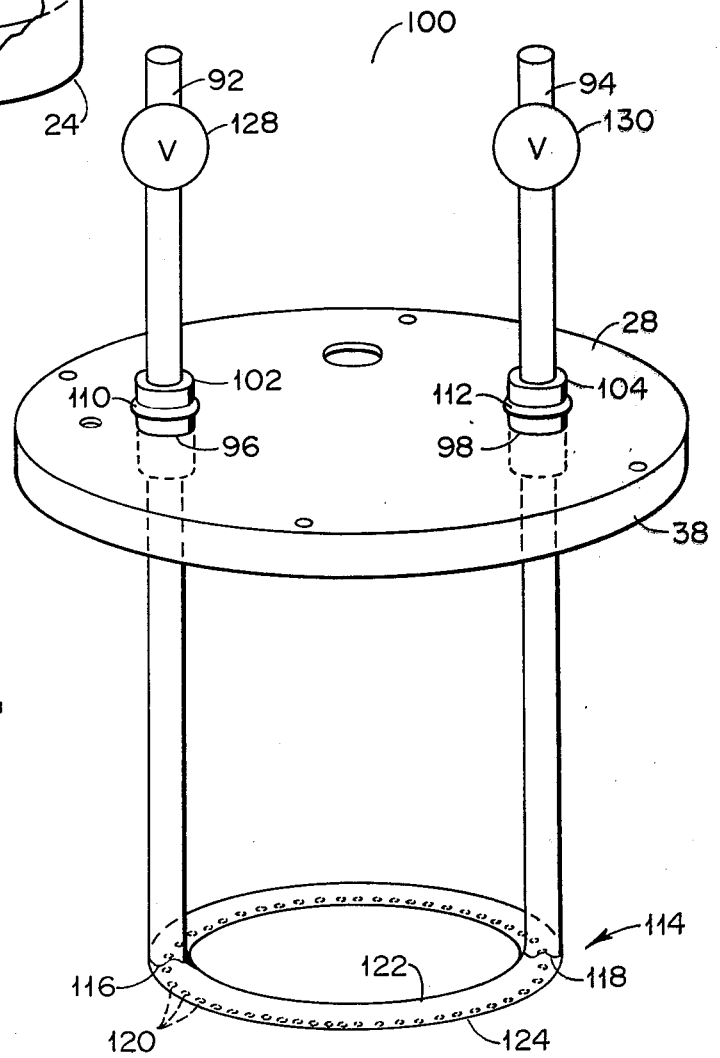
FIG. 2 is a representation of the intake means as shown in FIG. 1.
Figure 3:
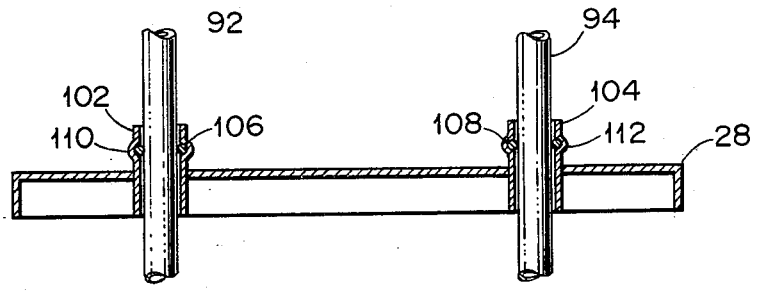
FIG. 3 is a sectional, side elevation view of a portion of the intake means shown in FIG. 2.

The illustrated intake means 90 further includes a tubular diffuser 114 joined at its opposite ends in a circular configuration. The lower ends 116 and 118 of the tubular inlets 92 and 94, as shown in FIG. 2, are connected to the diffuser 114 at spaced apart locations on the diffuser. Air entering the diffuser 114 through the inlets 92 and 94 exits the diffuser through a plurality of relatively small ports 120 spaced apart along that portion 122 of the wall 124 of the diffuser that faces the surface of the fuel contained in the chamber. The intake inlets 92 and 94 each preferably are of a relatively rigid material and function also to position the diffuser 114 within the chamber 30 in a substantially horizontal plane that is adjacent to, but vertically above and spaced apart from, the surface 125 of the liquid fuel within the chamber 30. The proximity of the diffuser 114 to the liquid level is thus adjustable by either adjusting the level of liquid fuel within the chamber or by adjusting the vertical height of the diffuser, or through a combination of these adjustments. When the engine 12 is in operation, air is drawn from the ambient atmosphere through the inlets 92 and 94 into the diffuser, and thence through the ports 120 which distribute the air within the chamber 30 adjacent the surface of the fuel 14 thereby enhancing fuel evaporation and producing a combustible mixture of fuel and air in the space 126 within the chamber 30 above the liquid fuel.

The illustrated intake inlets 92 and 94 are provided with valves 128 and 130 positioned external to the chamber 30 and spaced apart from the cylindrical housings 102 and 104 by a distance sufficient to allow vertical adjustment of the inlets. These valves 128 and 130 are of known check valve design and are preset for regulating the flow of air from the ambient atmosphere into the chamber 30.

The combustible fuel-air mixture is conveyed to the engine 12 by conduit means 132 that, in the illustrated embodiment, is connected to one of its ends 134 through the cover 28 of the fuel container means 20 to the interior of the chamber 30. The opposite end 136 of the conduit is connected to the combustion chamber (not shown) of a conventional internal combustion engine 12. A manually operable throttle valve 138 of known design is interposed in the conduit 132 and is selectively operable to control the flow of the combustible mixture to the engine.

Further, check valve means 140 of known design, which is biased in the closed position, is interposed in the conduit 132 between the throttle valve 138 and the fuel container 20. This valve provides for the flow of combustible mixture from the chamber 30 into the internal combustion engine 12, but closes the valve 140 in the event of an engine backfire thereby preventing or retarding the flow of flame and/or heat from the internal combustion engine to the fuel container chamber 30 to prevent ignition of the fuel in the fuel container as a result of such backfire event. Additionally, flame arrester means 142, such as a foraminous metallic material preferably is disposed in the conduit 132 to assist in isolating the fuel in the container means 20 from the combustion chamber of the internal combustion chamber. As necessary or desired, further like check valves and/or flame arrester means may be provided in the conduit 132.

As an additional safety feature, the conduit 132 is provided with a pressure relief means, generally referred to at 144 in FIG. 1, including a conduit 146 connected at one of its ends 148 in fluid communication with the conduit 132, and a check valve 150 of conventional design, spring biased in the closed position. During normal operation of the engine, the valve 150 remains closed, but in the event of excessive pressure build-up within the conduit 132, as upon the engine back-firing, the valve 150 opens to provide an outlet to ambient atmosphere of such pressure.

Figure 4:
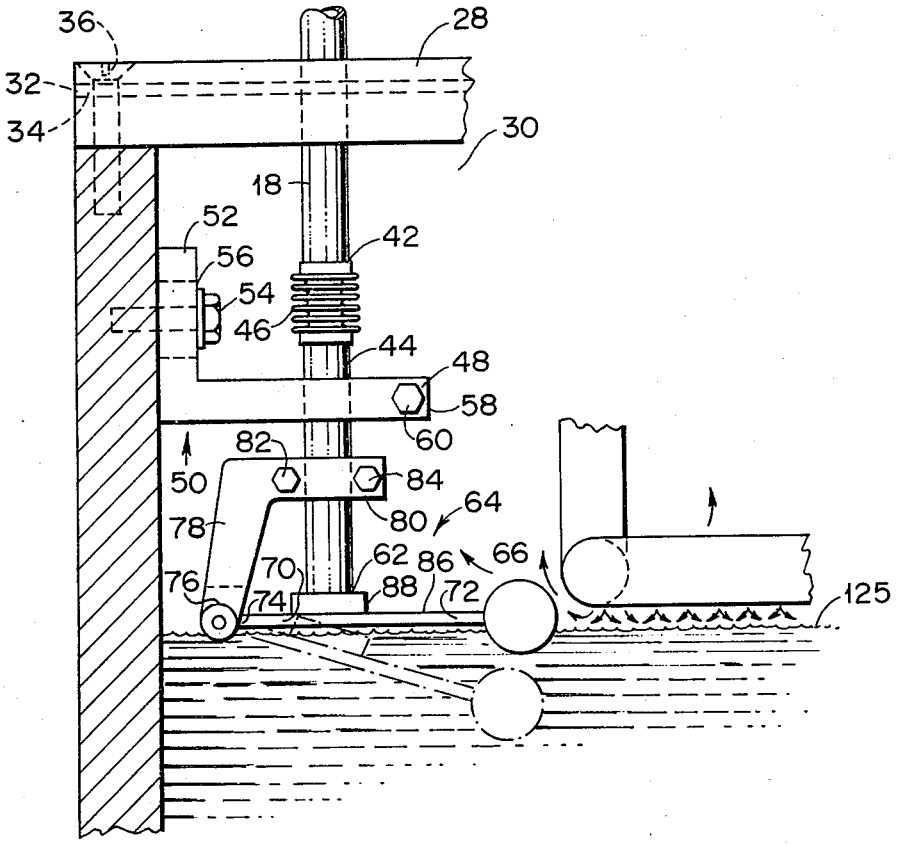
FIG. 4 is a side elevation view of the fuel control means shown in FIG. 1 with a portion of the container means broken away.
Figure 5:
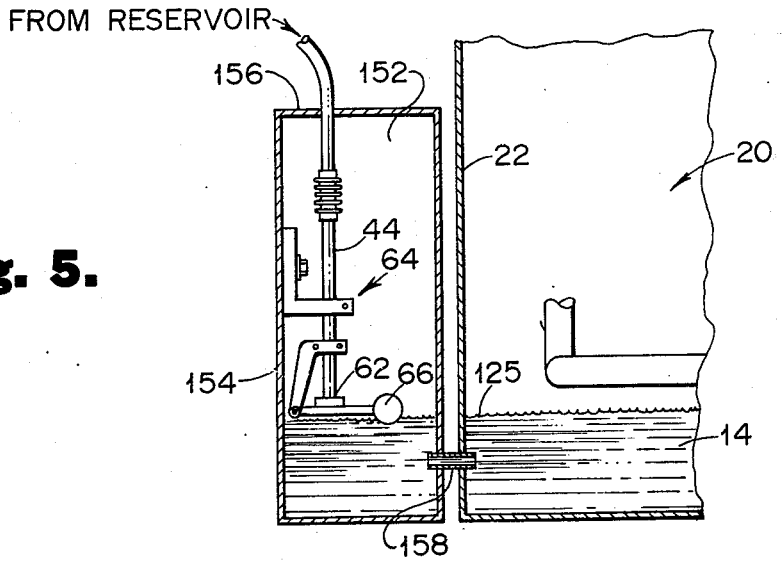
FIG. 5 is a further embodiment of a fuel control means with a portion of the container means broken away.

In an alternative construction illustrated in FIG. 5, the float valve 64 is disposed in an auxiliary chamber 152 defined by an auxiliary container 154 disposed adjacent the wall 22 of the container 20. The lower end 62 of the conduit 44, which serves as an outlet for fuel flowing from the reservoir 16, extends through a top wall 156 of the auxiliary container 154 and is opened and closed by means of the float valve 64 which is of like construction with the float valve shown in FIG. 4. A passage 158 extending from the auxiliary chamber 152 into the chamber 30 provides fluid communication between these two chambers and maintains the level of the fuel in the fuel container 20 equal to the level of fuel in the auxiliary chamber 152.

In one embodiment, the fuel container 20 was 6 inches in diameter and 14 inches high. The diffuser was mounted at the lower ends of the ½ inch internal diameter (ID) tubular inlets 92 and 94. The diffuser was formed from a ½ inch internal diameter tube joined at its opposite ends in a circular configuration having an inside diameter of about 4½ inches and an outside diameter of about 5½ inches. Approximately 150 ports were spaced apart along the lower portion of the diffuser adjacent the surface of the fuel contained within the chamber. The conduit 132 leading from the chamber 30 to the internal combustion engine was 1½ inches internal diameter tubing and was provided with a manually operable throttle for controlling the flow of the air-fuel mixture into the engine into the chamber for ignition. The engine employed was a conventional two-cylinder internal combustion engine. The conduit 132 was connected to the intake manifold of the engine at the usual location of a carburetor. In this embodiment, gasoline was used as fuel. Air was mixed with the gasoline using the described diffuser which was disposed about ¼ inch above and substantially parallel to the surface of the gasoline.

In operation of the present system, liquid fuel flows by gravity (or alternatively under induced pressure) from the fuel reservoir 16 into the chamber 30 of the fuel container means 20 through the conduit 18. When the fuel level in the chamber 30 reaches a predetermined level, the float 66 is raised to a position where the pad 88 closes the end 62 of the conduit 44 thereby halting the flow of fuel into the chamber. As the internal combustion engine operates, during and after a conventional "start" operation, it develops a vacuum within its combustion chamber that functions to pull air from ambient atmosphere through the inlets 92 and 94 and the diffuser 114 in the chamber 30. The air that is drawn into the chamber is dispersed in a plurality of streams that are each directed toward the surface 125 of the liquid fuel within the chamber. This action enhances evaporation of the fuel and has been found to provide one factor in controlling the richness of the combustible mixture. That is, the rate of vaporization of the fuel has been found to be selectable, within limits, by adjusting the proximity of the diffuser to the surface of the liquid fuel. Consequently, for given engine operating conditions, the rate of fuel usage is controllable through such proximity adjustment. Simultaneously, the flowing air is thoroughly mixed with the vaporized fuel in the chamber prior to introduction of the mixture into the combustion chamber. As desired, the quantity of air entering the intake inlets 92 and 94 is adjustable by means of the valves 128 and 130 to select the volume of air that enters the chamber under given engine operating conditions.

The combustible mixture is drawn through the conduit 132 into the combustion chamber of the internal combustion engine. The speed of the engine is controlled by manually operating the throttle means positioned within the conduit 132.

While a preferred embodiment has been shown and described, it will be understood that there is no intent to limit the invention by such disclosure, but rather, it is intended to cover all modifications and alternative constructions falling within the spirit and scope of the invention as defined in the appended claims.

What is claimed is:

1. In combination with an internal combustion engine having a variable volume combustion chamber, a carburetion systems comprising:

reservoir means containing a quantity of liquid fuel, closed container means defining a chamber, first conduit means providing fluid communication between said reservoir means and said container means, means, comprising a vertically adjustable bracket frictionally engaging said first conduit and a float valve secured to the lower end of said first conduit, regulating the flow of fuel from said reservoir to said chamber to that quantity of liquid fuel that establishes an adjustable predetermined level of liquid fuel within said chamber, air intake means providing fluid communication between ambient atmosphere external to said chamber and said chamber, and including diffuser means disposed within said chamber adjacent and above the surface of said fuel, said diffuser means being provided with a plurality of ports on that portion thereof that faces said surface of said liquid fuel whereby air passing through said air intake means is diffused into said chamber adjacent the surface of said fuel and forms a combustible gaseous mixture with said fuel above the surface of said fuel in said chamber and whereby diffused air does not pass upwardly through liquid fuel, sealed, slidably mounted means for adjusting the proximity of said diffuser means relative to said surface of said liquid fuel in said container means, further conduit means connecting said chamber at a location above the level of said liquid fuel therein to said combustion chamber, check valve means disposed in said further conduit means and establishing unidirectional fluid flow through said conduit means in the direction toward said internal combustion engine and away from said chamber, and throttle means selectively operable to regulate the flow of combustible mixture through said further conduit means into said internal combustion engine.

2. The carburetion system of claim 1 wherein said diffuser means comprises a cylindrical tube joined at its opposite ends, said diffuser means being mounted in a substantially horizontal plane at one end of said air intake means in fluid communication therewith, said tube being provided with a plurality of spaced apart ports along that portion of said tube wall which faces the surface of said fuel contained in said chamber whereby air passing through said air intake means passes through said ports thereby distributing said air across the surface of said fuel.

3. The carburetion system of claim 2 wherein said air intake means includes elongated tube means extending from said diffuser means through at least one wall of said fuel container means, said intake means providing fluid communication between the ambient atmosphere and said diffuser means.

4. The carburetion system of claim 1 including flame arrester means provided in said further conduit means.

5. The carburetion system of claim 1 and including pressure relief means interposed in said further conduit means along the length thereof and providing fluid communication between said further conduit means and the ambient atmosphere.

* * * * *